US005571992A

United States Patent [19]

Maleski et al.

[11] Patent Number: 5,571,992

[45] Date of Patent: Nov. 5, 1996

[54] LIGHTWEIGHT SHIELDED CABLE ASSEMBLY

[75] Inventors: Harry R. Maleski, Mesa; Mike D. Beadell, Apache Junction; Keith A. Kerfoot, Mesa, all of Ariz.

[73] Assignee: McDonnell Douglas Helicopter Co., Mesa, Ariz.

[21] Appl. No.: 329,089

[22] Filed: Oct. 25, 1994

[51] Int. Cl.[6] ..... H01B 11/06

[52] U.S. Cl. ..... 174/36; 174/105 R; 174/106 R; 174/109

[58] Field of Search ..... 174/36, 105 R, 174/105 SC, 106 R, 106 SC, 109, DIG. 8, 35 C

[56] References Cited

U.S. PATENT DOCUMENTS

| | | | |
|---|---|---|---|
| 3,484,532 | 12/1969 | Anderson | 174/36 |
| 3,576,387 | 4/1971 | Derby | 174/36 |
| 3,898,369 | 8/1975 | Clabburn | 174/36 |
| 3,917,900 | 11/1975 | Arnaudin | 174/107 |
| 4,477,693 | 10/1984 | Krabec et al. | 174/36 |
| 4,555,422 | 11/1985 | Nakamura | 428/36 |
| 4,598,165 | 7/1986 | Tsai | 174/36 |
| 4,693,323 | 9/1987 | Owensby | 174/35 C |
| 4,699,743 | 10/1987 | Nakamura | 264/104 |
| 4,766,267 | 8/1988 | Gray | 174/36 |
| 4,786,757 | 11/1988 | Owensby | 174/35 C |
| 4,896,000 | 1/1990 | Proctor | 174/74 R |
| 5,098,754 | 3/1992 | Gregory | 428/34.9 |
| 5,216,202 | 6/1993 | Yoshida et al. | 174/36 |
| 5,374,778 | 12/1994 | Hashimoto et al. | 174/36 |
| 5,399,808 | 3/1995 | Carter et al. | 174/80 |

FOREIGN PATENT DOCUMENTS 1259774 2/1968 United Kingdom .

OTHER PUBLICATIONS

Heat Shrinkable Shielding, pp. 29, 29; Insulationcircuits May 1973.

Conductive Heat–Shrinkable plastic, p. 23, Chomerics, Inc. Aug. 1969.

*Primary Examiner*—Kristine L. Kincaid
*Assistant Examiner*—Chau N. Nguyen
*Attorney, Agent, or Firm*—Freilich, Hornbaker, Rosen

[57] ABSTRACT

A cable assembly is described, which includes a bundle of wires (14, FIG. 1) and a shield structure (24) around them which is of light weight for aircraft applications, and which provides effective shielding especially against electromagnetic interference. The shield structure includes a metal braiding (32) sandwiched between radially outer and inner shrink tubes (34, 30), with each shrink tube having an electrically conductive coating (42, 40) in contact with the metal braiding. The inner shrink tube, which has a conductive coating on its outside surface, is initially shrunk around the bundle of wires to stabilize their positions. The tubular wire braiding is installed around the inner shrink tube and the outer shrink tube which has a conductive coating on its radially inner surface, is placed around the braiding. Then, the outer shrink is tube is heat shrunk in place. Sandwiching the wire braiding between two metal coatings provides enhanced interference protection.

8 Claims, 2 Drawing Sheets

FIG. 1
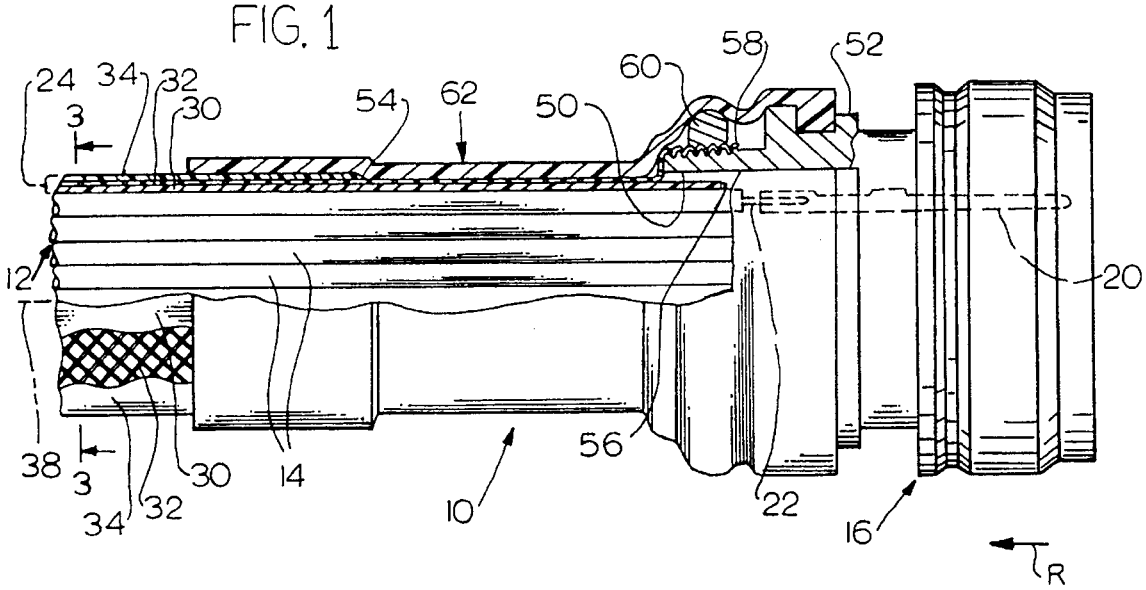
FIG. 2
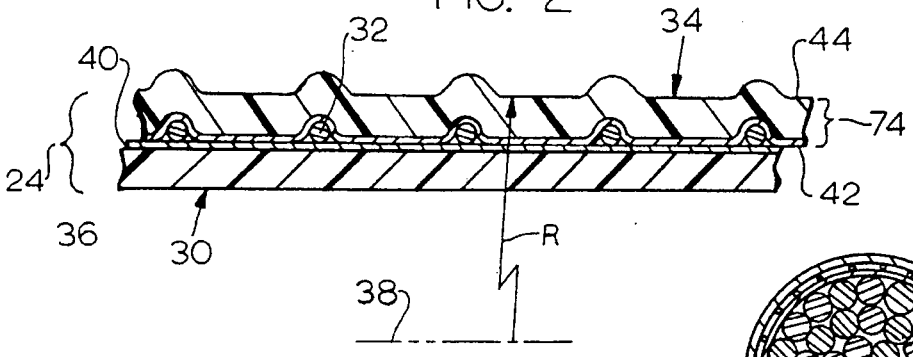
FIG. 3
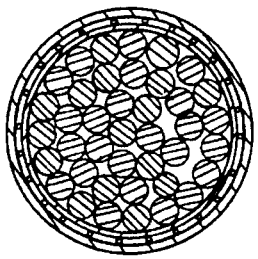
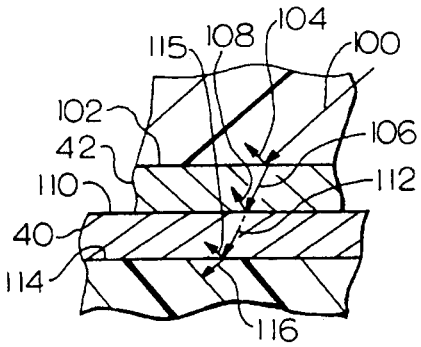
FIG. 5
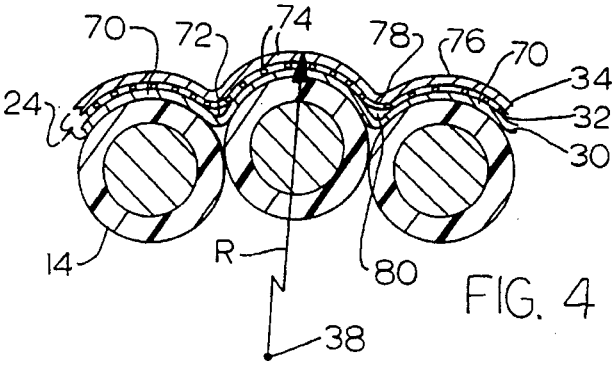
FIG. 4

LIGHTWEIGHT SHIELDED CABLE ASSEMBLY

BACKGROUND OF THE INVENTION

Cables used in aircraft must be shielded against EMI (electromagnetic interference). Such interference includes high current pulses such as from lightning which could damage components, and low current-high frequency signals which can induce currents in cable wires and thereby produce noise. Noise in the frequency range of about 30 to 88 and 115 to 156 MHz is especially objectionable, since aircraft FM and VHF radios communicate within these frequency bands. One presently used shield structure includes two layers of metal braiding placed around the cable. The two layers of wire braiding can conduct considerable current produced by lightning pulses to the airframe structure, thereby protecting the inner wires. There is a need to further reduce electromagnetic interference without increasing the weight of the cable assembly, and preferably in an assembly of reduced weight.

SUMMARY OF THE INVENTION

In accordance with one embodiment of the present invention, a cable assembly is provided which has EMI (electromagnetic interference) shielding that is highly effective at aircraft radio frequencies and which is of light weight. The assembly includes a cable having a plurality of insulated wires, an inner shrink tube lying tightly around the cable, a metal braiding lying around the inner shrink tube, and an outer shrink tube lying tightly around the metal braiding. While the outer shrink tube has an electrically conductive coating on its radially inner surface, the inner shrink tube has an electrically conductive coating on its radially outer surface. Accordingly, the wire braiding is sandwiched between the conductive coatings. Applicant finds that the two continuous conductive coatings provide enhanced EMI shield at aircraft radio frequencies.

The novel features of the invention are set forth with particularity in the appended claims. The invention will be best understood from the following description when read in conjunction with the accompanying drawings.

BRIEF DESCRIPTION OF THE DRAWINGS

FIG. 1 is a partially sectional side view of a cable assembly constructed in accordance with the present invention.

FIG. 2 is an enlarged view of a portion of the cable assembly of FIG. 1.

FIG. 3 is a view taken on line 3—3 of FIG. 1, but without showing deformation of the shielding assembly around the cable wires.

FIG. 4 is an enlarged view of a portion of the cable assembly of FIG. 3 showing the shielding assembly deformed about the cable wires.

FIG. 5 is an enlarged view of a portion of the assembly of FIG. 2, indicating a possible way in which high frequency signals are attenuated.

DESCRIPTION OF THE PREFERRED EMBODIMENT

Figure 6:
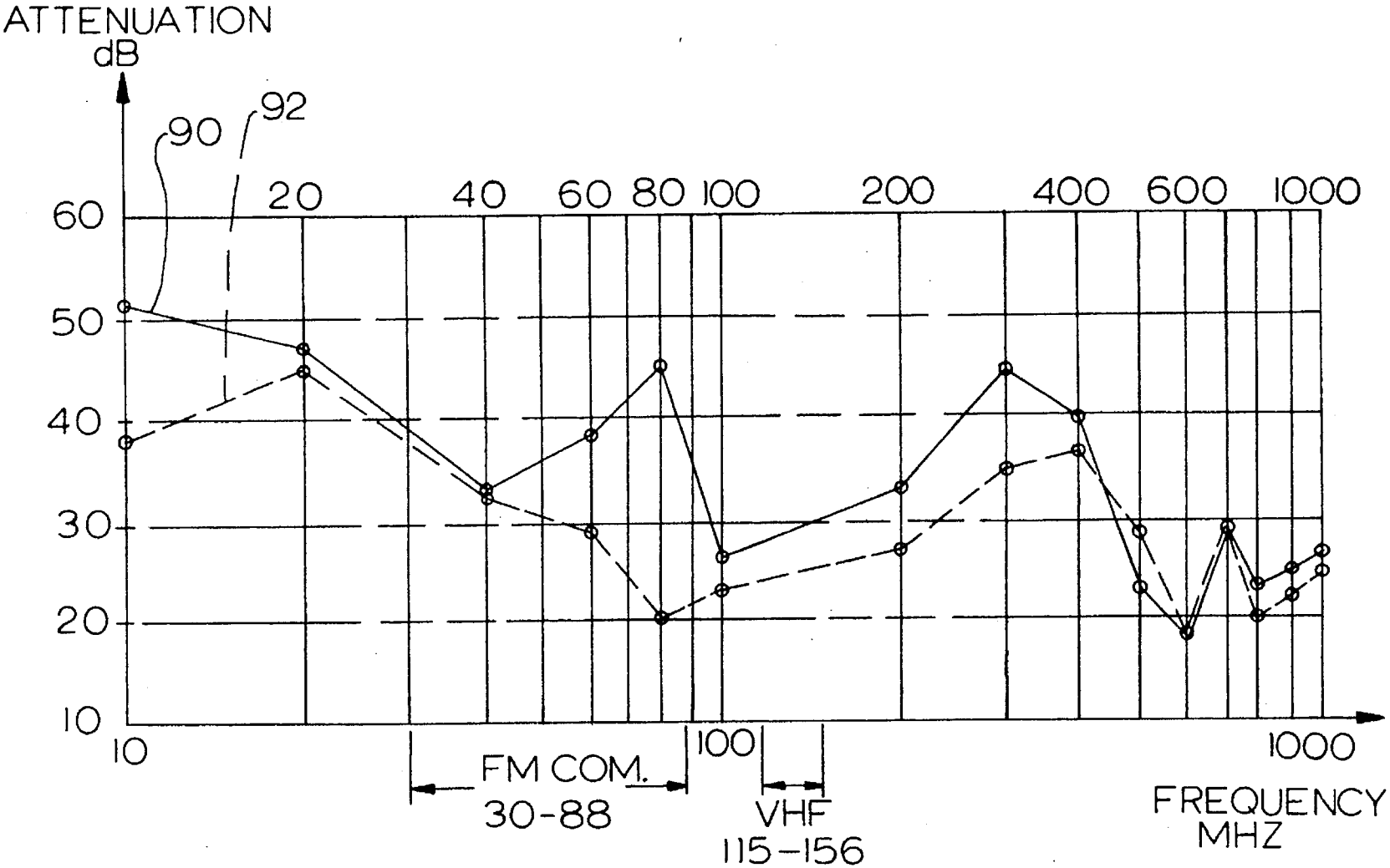
FIG. 6 is a graph showing variation of attenuation with frequency for the cable assembly of the present invention and of the prior art.

FIG. 1 illustrates a cable assembly 10 that includes a cable 12 which has a plurality of insulated wires 14 and which is terminated to a connector 16. The connector has numerous contacts 20 and each wire has a wire conductor 22 which is terminated to an end of a contact. The assembly also includes a protective EMI (electromagnetic interference) shield structure 24 lying around the cable to attenuate and reflect external electromagnetic fields and, in addition, to provide a low impedance current path to provide protection from the conductive effects of lightning strikes. Electromagnetic interference can result from lightning, external radio, television and radar transmitters, digital data transmissions and other equipment located on the same craft or other structures as the cable. A major application for the cable assembly is in aircraft, where it is especially desirable to reduce interference in communication systems and to eliminate interference in sensitive, electronic flight control systems and electronic engine controls. Aircraft applications require that the cable assembly be of light weight.

The EMI shield 24 includes an inner shrink tube 30 which is shrunk around the cable 12, a metal braiding 32 which lies closely around the inner shrink tube 30, and an outer shrink tube 34 which lies around the metal braiding. As shown in FIG. 2, the inner shrink tube 30 includes a plastic tube or thick layer 36 of heat shrinkable material such as a cross-linked polyolefin which has been expanded radially (away from the axis 38 of the tube and cable), and which tends to return to its original shape when heated. The shrink tube is metalized, in that it includes an electrically conductive coating 40, as of particles of metals such as silver held by a binder. The inner shrink tube is metalized on its radially outer surface, which is the surface that is in contact with the wire braiding 32. The braiding 32 is a mesh of metal such as copper or Monel. The outer shrink tube 34 is of the same construction as the inner one 30, except that the outer shrink tube has an electrically conductive coating 42 on the radially inner face of its heat shrinkable tube 44.

The cable 12 (FIG. 1) preferably includes a bundle of insulated wires without a jacket around them, but with the wires initially tied together at locations spaced perhaps three feet apart to keep them together. The absence of a jacket reduces weight, and is not required because of the EMI shield assembly. The inner shrink tube 30, in its original expanded configuration, is slipped around the bundle of wires that form the cable 12. The inner and outer shrink tubes each preferably extends along at least 50% of the entire length of the cable (between the connector and the opposite end of the cable which is connected to another connector component) and more preferably extends along substantially the entire length. Heat is applied to the inner shrink tube, which causes it to shrink tightly around the wires, and thereby hold the wires tightly in a compact bundle arrangement. After the inner shrink tube is in place, the end of the cable is projected completely through a passage 50 (FIG. 1) in a shell 52 of the connector 16. Insulation around the front of the wire conductors 22 is removed, or will have been already removed, and the wires are terminated to the connector contacts 20. The contacts and surrounding connector insulation (not shown) is then moved in a rearward direction R back into the connector shell 52.

The metal braiding is placed around the inner shrink tube 30 which already lies around the cable, and the outer shrink tube 34 is placed around the braiding. The outer shrink tube is placed with its front end 54 lying a distance rearward of the front end 56 of the inner shrink tube and the front end 58 of the braiding. Heat is applied to the outer shrink tube to shrink it and cause the braiding to contract tightly around the inner shrink tube. A clamp ring 60 such as one of TIMEL (titanium and nickel) which shrinks in diameter when heated, has been placed around the shell and is moved rearwardly to lie around the braiding. The clamp ring is heated so it contracts around the braiding to securely hold the braiding to the shell. A shrink boot 62, with a conductive coating on its radially inner surface, is mounted on the connector shell as shown, and extends rearward of the front end 54 of the outer shrink tube 34. The boot is heated to contract it around the outer shrink tube and braiding to hold them tightly in place and to help hold the cable assembly to the connector shell.

It is noted that in assembling the components, the inner shrink tube 30 is first placed around the cable and is heat shrunk around the cable independently of the outer shrink tube 34. This allows the inner shrink tube to hold the wires of the cable tightly together in the early stages of assembly of components. If the inner shrink tube were not independently heat-shrunk, but only the outer tube were heat-shrunk, then the inner tube 30 would not grip the cable as tightly. FIG. 4 shows that the inner tube 30 has inner-tube convex regions 70, which are convex with respect to the side thereof opposite the cable axis 38, which tightly grip wires 14 of the cable assembly. The inner shrink tube also has inner-tube concave regions 72 which penetrate partially into the space between adjacent wires. The combination 74 of the metal braiding 32 and outer shrink tube 34, which deform together, and have combination convex regions 76 that lie tightly around the inner-tube convex regions 70. However, the combination has combination concave regions 78 which do not lie tightly against the inner-tube concave regions 72, and which results in a gap 80 thereat. Thus, it is possible to determine, from the final cable assembly, that the inner shrink tube has been shrunk separately from the outer shrink tube.

Prior art EMI shields used two layers of braiding similar to braiding 32. That assembly provided sufficient protection against high current pulses from lightning (or the like), but did not provide sufficient protection against noise generated by external electromagnetic fields. Applicant prefers to use a single layer of braiding 32 and the prior outer shrink tube, together with the inner shrink tube with a metalized outer surface. Applicant finds that the combination of the two continuous electrically conductive layers 40, 42 of the inner and outer shrink tube, in combination with the single layer of braiding 32, provides adequate current-carrying capacity to avoid damage to components from most large current pulses likely to be encountered such as from lightning. Applicant finds that the presence of the two electrically conductive layers 40, 42 of the two shrink tubes, provides enhanced shielding against external electromagnetic fields.

Applicant has designed a cable assembly of the illustrated construction. The connector 16 has an outside diameter of 1¼ inch. Each of the shrink tubes 30, 34 has a thickness of about 7 mils (one mil equals one thousandth inch), with each conductive layer having a thickness of about 1 mil. The braiding 32 has copper wires of a thickness of 3 mils and spaced apart by about 25 mils. Since the shrink tubes are composed primarily of plastic, which is of low density, the addition of the inner shrink tube adds only a small additional weight. The shield assembly of the present invention had a weight that was about 65% of the weight of the best and most recent prior art shield assembly (which had 2 layers of thick braiding). However, the present assembly had superior shielding characteristics.

FIG. 6 includes a graph 90 showing the shielding effectiveness of the cable assembly of the present invention, and a graph 92 showing the effectiveness of the most recent prior art cable assembly which has been used in aircraft. The small circles along each graph represent the attenuation found at specific frequencies. The graph shows attenuation in decibels versus frequency in megahertz, and represent the results of tests and conducted on two 48 inch cable assemblies (90 for the present shield assembly 24, and 92 for the prior art shield assembly). It can be seen that at most frequencies, the present cable assembly (90) provides greater attenuation than that of the prior art (92). The attenuation is especially great in middle portions of the frequency band, of 30 MHz to 88 MHz, which is the primary band of frequency in which aircraft FM radios operate. It can be seen that at a frequency of 80 MHz, the present cable assembly (90) provided attenuation more than 20 dB better than for the prior art cable assembly in the 115 MHz to 156 MHz band, the attenuation is about 4 dB better.

Referring to FIG. 5, applicant believes that the higher attenuation of applicants' shield assembly 24 is largely due to it providing more interfaces where reflection occurs. In FIG. 5, arrow 100 represents an incoming electromagnetic wave. At interface 102 at the outer surface of the conductive layer 42, some of the electromagnetic energy is reflected as indicated arrow 104. A smaller amount of energy indicated by arrow 106 passes through the conductive layer 42 and a portion of it is reflected, as indicated by arrow 108, at the interface 110 of the two conductive layers 42, 40. The resulting energy indicated by arrow 112 reaches another interface 114 at the radially inner surface of the conductive layer 40, where another portion of the energy indicated by arrow 115 is reflected. This leaves only a relatively small amount of energy indicated by arrow 116, which causes only a small level of high frequency interference.

Thus, the cable assembly of the present invention is of light weight and provides adequate high current dissipation capability, while providing enhanced high frequency shielding, especially in the frequency range of 30 to 88 MHz of aircraft FM radio communication and 115 to 156 MHz of aircraft VHS radio communication. The cable assembly includes inner and outer shrink tubes with a metal braiding between them, wherein the shrink tubes have conductive coatings that both engage the braiding. The inner shrink tube is placed around the cable and heat shrunk in place independently of the outer shrink tube. The inner shrink tube can hold a bundle of wires that are devoid of a jacket around them, in a secure bundle. The inner shrink tube protects wires of the cable from damage from the metal braiding pressing into the wires. At the front of the assembly which includes a termination to a connector, the front end of the inner shrink tube preferably lies within a passage of the connector shell, while the braiding is terminated to the outside of the connector shell.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. In a cable assembly which includes a connector having a plurality of contacts, a cable having a plurality of insulated wires wherein each of said plurality of wires has a wire conductor connected to one of said contacts, and an EMI shield structure lying around said cable, wherein said shield structure includes a metal braiding and a metalized outer shrink tube lying around said metal braiding and having an inner surface and having a metal coating on its inner surface, the improvement comprising:

a metalized inner shrink tube extending around said cable, said inner shrink tube having an outer surface and having a metal coating on its outer surface which is in contact with said metal braiding.

2. The assembly described in claim 1 wherein:

said inner shrink tube is in direct shrink contact with said wires.

3. The assembly described in claim 1 wherein:

said cable has an axis and is devoid of a jacket around said wires, and a group of said wires forms the periphery of said cable;

said inner shrink tube has a plurality of tube convex regions each extending partially around a wire of said group, and has a plurality of tube concave regions each extending between a pair of wires of said group, as seen in a sectional view taken perpendicular to said cable axis;

said metal braiding and said outer shrink tube form a combination that has a plurality of combination convex regions each extending partially around and lying in intimate contact with one of said tube convex regions, and that has a plurality of combination concave regions each lying around one of said tube concave regions but being out of direct contact with said one of said tube concave regions.

4. The assembly described in claim 1 wherein said connector has a shell with front and rear end portions and with a through passage, said metal braiding extends around said shell rear portion, said assembly includes a clamp ring that clamps said braiding around said shell rear portion, and said assembly includes a shrinkable boot that lies around said clamp ring and that has a front end mounted on said shell, and that has a rear end lying around said outer shrink tube, wherein:

said inner shrink tube has a front end that extends into said passage of said shell.

5. A cable assembly comprising:

a bundle of wires having an axis;

an inner shrink tube lying around said bundle of wires and shrunk tightly thereabout;

a metal braiding lying around said inner shrink tube;

an outer shrink tube lying around said metal braiding and shrunk tightly thereabout;

said inner shrink tube having a radially outer surface region comprising a layer of metal, and said outer shrink tube having a radially inner surface region comprising a layer of metal, with said metal braiding being sandwiched between and in contact with both of said layers of metal.

6. The cable assembly described in claim 5 wherein:

said inner shrink tube is in direct shrink contact with said wires.

7. A method for shielding a cable which includes a bundle of insulated wires, comprising:

slipping a metalized inner shrink tube around a cable, wherein said inner shrink tube has an electrically conductive coating on its outer surface;

heating said inner shrink tube to shrink it around said cable;

slipping a metal braiding around said inner shrink tube and slipping an outer shrink tube around said metal braiding, and heating said outer shrink tube to cause it to contract closely around said metal braiding to deform said metal braiding closely around said inner shrink tube.

8. The method described in claim 7 wherein:

said step of heating said inner shrink tube is performed before said step of slipping on said outer shrink tube, to thereby separately shrink said inner and outer shrink tubes.

* * * * *